United States Patent [19]

Jaworski et al.

[11] 4,163,558

[45] Aug. 7, 1979

[54] VIBRATORY GAME APPARATUS

[75] Inventors: Eugene Jaworski, Park Ridge; Jeffrey D. Breslow, Highland Park, both of Ill.

[73] Assignee: Marvin Glass & Associates, Chicago, Ill.

[21] Appl. No.: 872,429

[22] Filed: Jan. 26, 1978

[51] Int. Cl.[2] ..... A63B 71/04; A63F 9/00

[52] U.S. Cl. ..... 273/115; 46/1 C

[58] Field of Search ..... 46/1 C, 47; 273/86 E, 273/109, 111, 115

[56] References Cited

U.S. PATENT DOCUMENTS

| | | | |
|---|---|---|---|
| 2,512,288 | 6/1950 | Schumacher | 46/47 |
| 2,660,001 | 11/1953 | Smith et al. | 46/1 C |
| 2,882,644 | 4/1959 | Bonanno et al. | 273/86 E |
| 3,063,191 | 11/1962 | Main | 46/47 |
| 3,841,636 | 10/1974 | Meyer | 46/1 C |
| 3,855,725 | 12/1974 | Tollefson | 46/1 C |

FOREIGN PATENT DOCUMENTS

| | | | |
|---|---|---|---|
| 752933 | 4/1954 | United Kingdom | 46/1 C |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A vibratory game apparatus for use with a plurality of game pieces movable over a playing surface in response to vibration thereof comprises an open top enclosure or arena for containing a group of said game pieces during play. The enclosure includes a floor which comprises a vibratory playing surface and an upstanding sidewall or fence formed around the outer periphery of the playing surface which is vibrated by means of one or more elongated elements having teeth along one edge adapted to be manipulated longitudinally back and forth with the teeth in engagement with an upper edge portion of the sidewall thereby imparting vibratory action to the playing surface via the vibrating sidewall structure. The enclosure or arena includes a plurality of inner compartments or corrals, each having a pair of fixed sidewalls angularly disposed with respect to one another and a movable wall which is manually operated by a control arm to open and close with respect to the fixed wall for corralling the game pieces in the compartment as they move around the vibratory playing surface. Each player's skill in opening and closing the movable wall of an assigned inner compartment or corral and hold a maximum number of game pieces determines the winner of the game.

12 Claims, 4 Drawing Figures

Fig 1
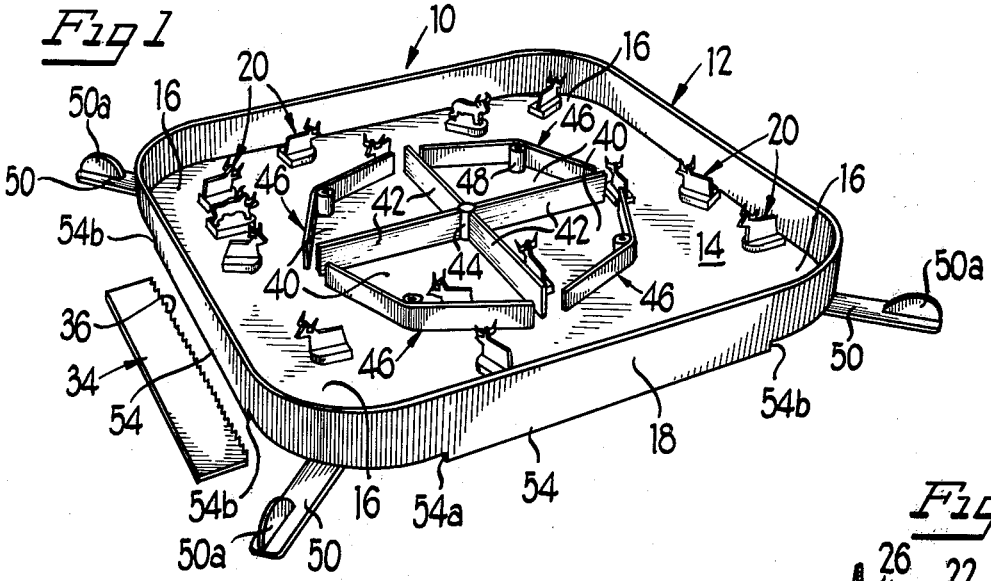
Fig 4
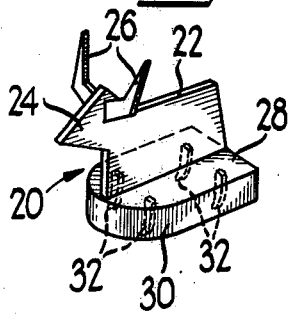
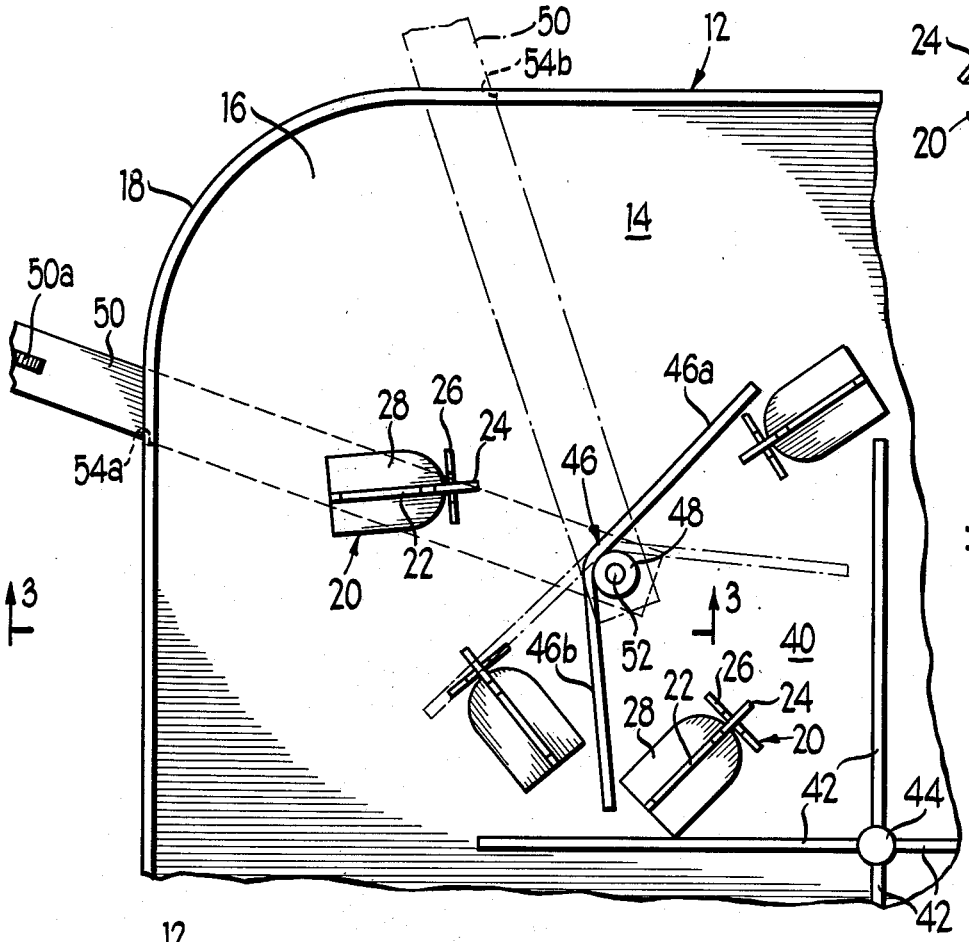
Fig 2
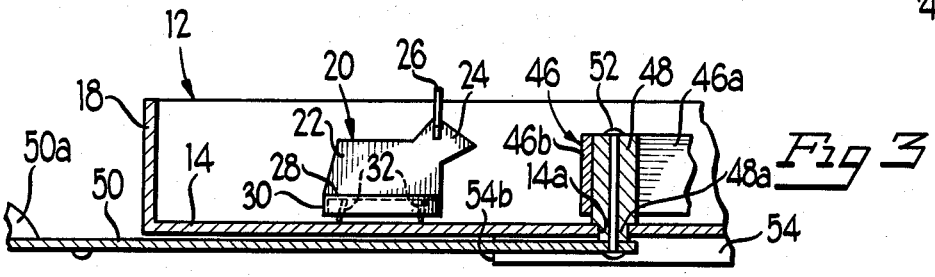
Fig 3

VIBRATORY GAME APPARATUS

BACKGROUND OF THE INVENTION

1. Field of the Invention

The present invention relates generally to a vibratory game apparatus wherein game pieces are made to move over a playing surface in response to the vibration of the surface. Each player is assigned an inner compartment or corral within a larger arena containing free game pieces and each corral includes a manually controllable, movable wall which is operable during the game to corral and retain as many game pieces as possible in the corral controlled by the player.

2. Description of the Prior Art

A variety of vibratory game apparatus have been developed wherein game pieces are movable over a vibratory playing surface in response to the vibration thereof. In some of these devices, the game pieces move along a controlled, well defined pathway in a particular direction such as in loading and unloading a railroad car, truck or other vehicle. Other types of prior art games have been designed around the theme of capturing or corralling a maximum number of game pieces of various types in a confined area and the object of these games is to capture and keep more game pieces than the opposing players.

SUMMARY OF THE INVENTION

It is an object of the present invention to provide a new and improved vibratory game apparatus for use with game pieces which are movable over a playing surface in response to the vibration thereof.

More particularly, it is an object of the invention to provide a new and improved vibratory game apparatus of the character described wherein novel means are provided for generating a vibratory motion in the playing surface.

Another object of the invention is to provide a new and improved vibratory game apparatus of the character described which is developed around the theme of corralling a maximum number of game pieces which are fashioned in the form of cattle or other animals into an individually controlled compartment or corral inside a larger arena.

Yet another object of the present invention is to provide a new and improved vibratory game apparatus of the character described wherein each player is assigned a corral or compartment within a larger arena and the corral is provided with a movable wall which is manually controlled by the player to direct the moving game pieces into the player's corral.

Yet another object of the present invention is to provide a new and improved vibratory game apparatus of the character described which provides competition between players and which is helpful in developing motor skills of the players.

Yet another object of the present invention is to provide a new and improved vibratory game apparatus of the character described which is exciting and fun to play and which is simple and straight forward in construction and operation.

The foregoing and other objects and advantages of the present invention are accomplished in a preferred embodiment comprising a vibratory game apparatus using a plurality of game pieces designed to resemble cattle which are movable over a playing surface in response to the vibration thereof. An open top enclosure or large arena is provided for containing a plurality of game pieces during play and the enclosure includes a floor which is vibrated causing the game pieces to move. An outer fence or sidewall is formed around the outer periphery of the playing surface for containing the game pieces and one or more elongated elements having teeth along one edge are provided for manipulation longitudinally back and forth with the teeth against an upper edge portion of the sidewall thereby imparting vibration motion via the sidewall into the playing surface. Each player is assigned an exclusive inner compartment or corral within the larger arena containing free game pieces and the corral includes a fixed wall and a movable wall which is controlled by operation of a control arm extending outwardly of the arena. The control arm is operable to position the movable wall to open and close with respect to the fixed wall for guiding the game pieces into the corral and for keeping them in the corral while attempting to corral or capture additional game pieces moving around the free area of the arena.

BRIEF DESCRIPTION OF THE DRAWINGS

For a better understanding of the present invention, reference should be had to the following detailed description taken in conjunction with the drawings, in which:

FIG. 1 is a perspective view of a new and improved vibratory game apparatus constructed in accordance with the features of the present invention and shown as the apparatus is in position ready for play;

FIG. 2 is a fragmentary, top plan view of the game apparatus of FIG. 1;

FIG. 3 is a fragmentary, vertical sectional view taken substantially along lines 3—3 of FIG. 2; and FIG. 4 is a perspective view illustrating a game piece in accordance with the features of the present invention.

DESCRIPTION OF THE PREFERRED EMBODIMENT

Referring now more particularly to the drawings, therein is illustrated a new and improved vibratory game apparatus constructed in accordance with the features of the present invention and referred to generally by the reference numeral 10. The game apparatus includes a relatively large, open top, rectangular arena or enclosure 12 having a square shaped bottom wall 14 formed with rounded corners 16 and an upstanding peripheral sidewall or fence 18 around the outer edge. The enclosure 12 is adapted to contain a plurality of game pieces 20 which are fashioned to resemble cattle or other farm animals and which are adapted to move in response to the vibration of the playing surface 14 of the arena or corral.

In this connection, each of the game pieces 20 includes an upstanding body portion 22 formed to resemble the profile of a cow or steer with a head 24 at the forward end and a pair of laterally outwardly projecting horns 26. The body 22 is supported upon a base 28 having a rounded forward end and a depending skirt or side wall 30 which substantially encloses a plurality of resilient filaments or legs 32 which depend and slope downwardly and rearwardly of the base 28 as shown in FIGS. 3 and 4. The slender, filament-like legs project downwardly below the lower edge of the skirt 30 and support the game piece 20 so that it tends to move in a random fashion in a generally forward direction whenever the supporting playing surface 14 is vibrated. Because of the slope of the legs, the game pieces will move in a forward direction most of the time, however, the game pieces also move laterally and occasionally rearwardly depending upon the amplitude and the phase of vibration motion of the supporting playing surface 14 at a particular location thereon. Preferably, the game pieces 20 are formed of integrally molded plastic material and the filament-like legs 32 are rounded at their lower ends and are relatively resilient and flexible.

In accordance with the invention, the arena or enclosure 12 is activated so that the floor 14 vibrates by means of one or more elongated elements 34 having saw teeth 36 along one edge. The element 34 resembles a comb or saw blade and is reciprocated longitudinally back and forth with the teeth 36 in engagement with an upper edge portion(s) of the outer fence 18. Preferably, the enclosure 12 is formed of integrally molded plastic material and the vibration imparted to the fence or peripheral wall 18 by reciprocation of the saw element(s) 34 imparts vibrating movement to the floor 14 which in turn causes the game pieces or cattle 20 to move around. Each player may be provided with a saw-like element 34 or only a single element may be provided, with each player having a turn at using the element for a selected length of time.

In accordance with the invention, the outer portion of the arena is a free area for the cattle and in a central portion of the arena there is provided a cluster of smaller corrals or individual compartments 40, with one or more compartment or corral being exclusively assigned to each of the players in the game. Each compartment includes a pair of fixed inner sidewalls 42 extending at right angles to one another and radiating outwardly from an upstanding center post 44 in the middle of the arena. The fixed inner walls 42 of the corrals 40, extend outwardly toward the mid-section of each side of the peripheral fence 18 and terminate well short of contact therewith in order to provide the free area or annular grazing area in which the game pieces 20 are initially placed at the start of the game.

Each inner corral 40 is provided with a movable wall member 46 supported for pivotal movement on an upstanding axle 48 which includes a reduced diameter lower end portion **48*a* (FIG. 3) seated for rotation within a circular opening 14*a* formed in the playing surface 14 and spaced approximately midway between the center post 44 and an adjacent corner section 16. The movable wall members 46 include left and right half portions 46*a* and 46*b* (FIG. 2) which extend angularly outward from the central supporting posts 48 and the halves are at an obtuse angle in relation to each other. As shown in FIG. 2, the respective halves 46*a* and 46*b* are dimensioned in length to that their outer free ends are always spaced from the adjacent surfaces of the fixed walls 42 as shown. Each wall member 46 is movable between a first (righthand) open position (solid lines) wherein the outer end of the (lefthand) half 46*a* is spaced from an adjacent fixed wall 42 by a distance great enough to permit the entry of a game piece 20 into the compartment 40 as shown. In this position, the opposite (righthand) half 46*b* is in a closed position with respect to an adjacent fixed wall 42 and the clearance between the outer end of the (righthand) half 46*b* and the adjacent fixed wall is not great enough to permit the entry or escape of a game piece 20** into or out of the corral.

The wall member 46 is movable from the (righthand) open position, shown in solid lines, to a second (lefthand) open position shown in dotted lines, wherein the outer free end of the (lefthand) half portion **46*a* is spaced closely to the adjacent fixed wall 42 so that there is not enough clearance to permit passage of a game piece 20 into or out of the corral 40. The opposite (righthand) half 46*b* is in an open position as shown and ample clearance is provided to permit the game pieces 20 to move into and out of the corral. From the foregoing it will be seen that when the movable wall member 46 is positioned in one open position, the game pieces 20 may move in and out adjacent one corner of the corral 40 but may not move in and out adjacent the opposite corner. When the wall member is moved to the opposite open position, the reverse is true. The movable wall member is also movable into an intermediate or closed position wherein both outer ends of the respective halves 46*a* and 46*b* are close enough to the respective fixed walls 42 to block all entry and exit of game pieces into and out of the compartment 40**. The fully closed position is midway between the opposite open positions as shown in solid and dotted lines in FIG. 2.

In order to permit the player to control and move the wall member 46 with respect to his assigned compartment or corral 40, each movable wall is provided with an outwardly extending control arm 50 having an inner end secured to the lower end portion **48*a* of the wall support post 48 by means of a rivet-like fastener 52 extending through a hollow central bore in the support post. Referring to FIG. 2, when the lever arm 50 is in the position shown in solid lines, the righthand edge thereof bears against a vertical stop surface 54*a* of a depending leg segment 54 integral with the outer wall 18 and depending downwardly of the playing surface 14. The legs 54 are formed on all sides of the arena and support the playing surface 14 above the general playing area in which the game apparatus is being used so that vibration is not impeded. As shown in FIGS. 1 and 3, the leg segments 54 extend between the rounded corners of the arena and the left and righthand edges 54*a* and 54*b*, respectively, of each leg segment provide stop surfaces for limiting the pivotal movement of the control arms 50. Each player can move his control arm 50 through an angular range which is limited by engagement between the opposite edges of the arm and the respective stop edges 54*a* and 54*b* of the support leg structures 54. Whenever a control arm is in a position against one of the stop edges, at least one of the halves 46*a* or 46*b* of the movable wall member is in an open position to permit the entry or exit of a game piece 20 into or out of the associated corral 40. When the control arms 50 are in a centered position on a diagonal with respect to the rounded corners 16 (FIG. 1), the movable wall members are in a fully closed position so that the playing pieces 20 cannot pass into or out of the respective inner corrals or compartments 40**.

In playing the game, a number of game pieces 20 are randomly positioned in an annular grazing area of the enclosure or arena 12 outwardly of the respective compartments 40. If four players are in the game, each player is assigned one of the inner corrals 40 and has control of its wall member 46 by means of the lever 50 associated therewith. To facilitate movement of the levers, they are provided with upstanding tabs **50*a* adjacent the outer end portions which extend outwardly of the curved corners of the arena 12. To start the game, one of the players utilizes the elongated comb-like or saw tooth element 34 on an adjacent upstanding portion of the fence 18 to impart vibratory movement to the playing surface 14. The game pieces 20 then begin to move around the arena and as they approach the respective compartments 40, the players manipulate their control arms 50 and attempt to corral and retain a maximum number of game pieces within their respective compartments. The heads 24 and horns 26 of the game pieces 20 may engage the walls 18, 42 and 46 and be deflected thereby and the players exercising the greatest skill in manipulation of the control arms can help to guide and direct the game pieces into their respective corrals 40 while attempting to retain those game pieces already captured inside the corral. At the end of the game, the player having corralled and retained the largest number of game pieces is declared the winner. The game may be continued until all of the game pieces are captured in the inner corrals 40 or the game may be stopped after a set time limit expires. From the foregoing it will be seen that the game apparatus 10** of the present invention provides entertainment and excitement and is useful in developing motor skills as well as the competitive spirit for children and adults alike.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A competitive vibratory game apparatus for use with one or more game pieces movable over a playing surface in response to vibration thereof, comprising:

an enclosure for containing said game pieces during play including a floor comprising said playing surface with an upstanding sidewall around the outer periphery of said surface;

a plurality of compartments inwardly of said sidewall on said playing surface, each compartment including a fixed upstanding wall portion and a movable upstanding wall portion manually operable to open and close with respect to said fixed wall portion for corralling said game pieces in said compartment; and a plurality of selectively operable means for vibrating said playing surface, each including an elongated element having teeth along at least one edge adapted to be manipulated longitudinally with said teeth engaging a player selected portion of said sidewall for imparting player induced vibrations to various sections of said sidewall and said playing surface to control the movement of the playing pieces.

2. The game apparatus of claim 1 wherein said playing surface and said sidewall are integrally joined together thereby transmitting vibration of said sidewall to said playing surface.

3. The game apparatus of claim 1 including leg means for supporting said enclosure above a supporting surface and control arm means below said playing surface attached to said movable wall portion and extending outwardly beyond said sidewall for manipulation to open and close said movable wall portion with respect to said fixed wall portion.

4. A vibratory game apparatus for use with one or more game pieces movable over a playing surface in response to vibration thereof, comprising:

an open topped enclosure for containing said game pieces during play including a floor comprising said playing surface with an upstanding sidewall around the outer periphery thereof;

a plurality of compartments inwardly of said sidewall on said playing surface, said compartments including a fixed upstanding wall portion including a plurality of inside walls interconnected at a common center and projecting outwardly of said center with adjacent pairs of inside walls forming fixed walls for each compartment and a movable upstanding wall member for each compartment manually operable to open and close with respect to said fixed walls for corralling said game pieces in said compartment, said movable upstanding wall portions being supported on an upstanding pivot axle at its center;

means for vibrating said playing surface including an elongated element having teeth along one edge adapted to be manipulated longitudinally with said teeth engaging an upper edge of said side wall for imparting vibration through said side wall to said playing surface;

means for supporting said enclosure above a supporting surface; and control arm means below said playing surface attached to each of said movable wall portions and extending outwardly beyond said side wall for manipulation to open and close said movable wall portions with respect to said fixed walls, said control arm means including a control arm for independently controlling the rotation of the pivotal axle of each movable wall portion.

5. The game apparatus of claim 4 wherein said playing surface is generally square in shape with rounded corners, said support means including leg segments between said corners extending downwardly of said playing surface, each leg segment having opposite edges forming stops for limiting the pivotal movement of said control arms, said control arm extending outwardly of said corners.

6. The game apparatus of claim 5 wherein each control arm includes an upstanding tab adjacent an outer end to facilitate grasping by the players of said game.

7. The game apparatus of claim 5 wherein said fixed walls of each compartment extend outwardly of a center point of said playing surface midway between said rounded corners at right angles to one another, said pivot axles spaced outwardly of said center point on a line extending through a corner and inwardly thereof.

8. The game apparatus of claim 7 wherein said wall member of each compartment includes a pair of half portions extending outwardly from opposite sides of said pivot axle and terminating at an outer end short of an adjacent fixed wall.

9. The game apparatus of claim 8 wherein said half portions of each wall member are arranged with an obtuse angle therebetween and are of a length such that when the member is positioned with the clearance between the outer end of one half portion and the adjacent fixed wall less than that required to pass a game piece therebetween the clearance between the outer end of the opposite half portion and the adjacent fixed wall thereto is large enough to pass a game piece therebetween.

10. The game apparatus of claim 9 wherein each of said wall members is movable by a control arm between a closed position wherein the outer ends of both half portions are spaced apart from adjacent fixed walls by a clearance less than that required to pass a playing piece and a pair of open position wherein one or the other wall portion in position with an outer end spaced apart from an adjacent fixed wall by a distance large enough to pass a playing piece.

11. The game apparatus of claim 10 wherein movement of said control arms against a stop edge of a leg segment moves the corresponding movable wall segment into one of said open positions.

12. The game apparatus of claim 11 wherein movement of said control arms to a position midway between adjacent stop edges on opposite leg segments moves the corresponding wall segment into said closed position.

* * * * *